United States Patent [19]

Ackerman

[11] 4,367,697

[45] Jan. 11, 1983

[54] MULTI-ZONE BOILER FOR FIRING WITH SOLID AND LIQUID FUEL

[76] Inventor: Karl Ackerman, Marktplatz, Massing, Rott, Fed. Rep. of Germany

[21] Appl. No.: 212,733

[22] PCT Filed: Mar. 13, 1980

[86] PCT No.: PCT/DE80/00029

§ 371 Date: Nov. 5, 1980

§ 102(e) Date: Nov. 5, 1980

[87] PCT Pub. No.: WO80/01947

PCT Pub. Date: Sep. 18, 1980

[30] Foreign Application Priority Data

Mar. 13, 1979 [DE] Fed. Rep. of Germany ..... 2909720

[51] Int. Cl.[3] ..... F22B 31/04

[52] U.S. Cl. ..... 122/2; 122/22; 122/44 A; 122/155 A

[58] Field of Search ..... 122/22, 2, 149, 44 A, 122/155 A

[56] References Cited

U.S. PATENT DOCUMENTS

| | | | |
|---|---|---|---|
| 73,363 | 1/1868 | Miller | 122/155 A |
| 1,943,622 | 1/1934 | Piatt | 122/44 A |
| 3,213,832 | 10/1965 | Jakobsson | 122/2 |
| 3,223,074 | 12/1965 | Tanner et al. | 122/2 |
| 4,206,723 | 6/1980 | Kunkel | 122/22 |
| 4,296,711 | 10/1981 | Bilberg | 122/22 |

FOREIGN PATENT DOCUMENTS

| | | |
|---|---|---|
| 1102368 | 3/1961 | Fed. Rep. of Germany . |
| 75083102 | 7/1975 | Fed. Rep. of Germany . |
| 1277439 | 10/1961 | France . |
| 2275735 | 1/1976 | France . |
| 186199 | 9/1936 | Switzerland . |
| 650885 | 3/1951 | United Kingdom . |
| 1066788 | 4/1967 | United Kingdom . |

*Primary Examiner*—Henry C. Yuen

*Attorney, Agent, or Firm*—Oblon, Fisher, Spivak, McClelland & Maier

[57] ABSTRACT

A furnace for alternatively burning solid or liquid fuels is disclosed. The furnace includes an oil burner and a solid fuel burner as well as a combustion chamber for the burning fuel. The hot combustion gases can be introduced through one of two sets of chimney gas flues, depending upon the fuel being burned. A tiltable flap at the inlet of the chimney gas flues controls which set of flues the gas passes through. At the outlet of the flues, a reversing chamber reverses the direction of the gases and directs them to a flue gas pipe for removing the combustion gases from the furnace. The position of the tiltable flap is controlled by a control means responsive to the sensed temperature of the gas leaving the furnace. The chimney gas flues define a heat exchanger and may be formed from flat plates or round ducts.

9 Claims, 4 Drawing Figures

MULTI-ZONE BOILER FOR FIRING WITH SOLID AND LIQUID FUEL

TECHNICAL FIELD

The invention relates to a multi-zone boiler designed to be fired alternatively with solid and liquid fuel, comprising a hopper for the solid fuel and a burner for the liquid fuel to be burned therein, the hopper communicating with a combustion chamber which, in turn, communicates with flue gas ducts made as heat exchangers and leading to a flue.

DESCRIPTION OF THE PRIOR ART

It was found that when solid fuel is used for firing a boiler the flue gas ducts are in time heavily coated with soot. If the boiler is then subsequently fired with oil, without thorough prior cleaning of the flue gas ducts, the heat transfer, due to the walls of the flue gas ducts being covered with soot, is significantly reduced. In that case full energy output may no longer be obtained from the boiler.

It was also found that the outlet temperature has not always the desired set value.

The aim of the invention is to find a way of obtaining the optimum heating output even in boilers fired alternatively with solid and liquid fuel, and of economically utilizing the heating energy.

This is achieved according to the invention in that the boiler has two flue gas ducts or two groups of flue gas ducts and one or other of the ducts or the groups thereof may be disconnected, either fully or partly to a selected degree, from the path of flow of the flue gases depending on the choice of fuel.

When such a boiler is fired with solid fuel one of the flue gas ducts or one of the groups of flue gas ducts is disconnected from the path of flow of the flue gases so that only the walls of the other flue gas duct or other group of flue gas ducts come into contact with the flue gases and consequently only these walls are in time covered with a significant layer of soot. If the firing of the boiler is switched over to liquid fuel firing, the flue gas ducts which were first disconnected from the path of flow of the flue gases are opened either fully or partly for the flue gases and due to their clean walls the maximum heat exchange output is obtained in them. The ducts through which flue gases flow when the boiler is fired with solid fuel are preferably disconnected from the flow of the flue gases when the boiler is fired with liquid fuel. The heating output which is thereby achieved is determined by the number of the fully or partly opened flue gas ducts. Due to the walls being clean it is however optimum. It may be ascertained by measuring the temperature of the outlet gases in the flue of the boiler whether the measured low temperature corresponds to the regulations and whether therefore the desired heat utilization has been achieved, and a different setting may be decided upon.

BACKGROUND OF THE INVENTION

According to a preferred embodiment of the invention one or more tiltable closure flaps are provided at the upper end of the flue gas ducts for the connection or disconnection of the one flue gas duct or group of flue gas ducts. Such a closure flap may be situated between the flue gas ducts and serves alternatively for complete or partial closure of one or the other of the ducts. Preferably a central position of the closure flap may be set in which all the groups of flue gas ducts are opened for the flue gases to flow therethrough. In this setting, due to the increase of the surface available for the heat exchange, a higher energy output is obtained when firing with liquid fuel, because the hot gases flow through the clean ducts for firing with liquid fuel and simultaneously also through the ducts for firing with solid fuel which may be covered with soot.

In order to adapt the heating output of the boiler even better to requirements due to specific circumstances, the closure flap preferably incorporates a plurality of individual flaps by means of which the ducts may be covered either fully or partly. The closure flap is preferably controllable from outside the boiler. Particularly according to a preferred embodiment of the invention a control mechanism is provided for the closure flaps by means of which the setting of the closure flaps is controllable according to the sensed temperature of the outlet gases. This ensures that when the temperature of the outlet gases is low the flap may be fully or nearly fully closed and when it is high it may be opened in order to utilize energy economically.

According to a further embodiment of the invention the ducts are formed by two or more mutually parallel fire tubes. In order to act as heat exchangers the fire tubes are surrounded by a jacket for the flow of water to be heated. The advantage of the use of fire tubes is that they can be easily and reliably cleaned by a round brush so that after cleaning the whole wall surface is again available for maximum energy transfer.

According to a further embodiment of the invention the ducts may be formed instead by a plurality of spaced apart mutually parallel wall surfaces which are made as water heating pockets for the flow of water to be heated therethrough. When the ducts are made in this way a particularly large wall surface is available for the exchange of heat. The disadvantage of ducts made in this way is that their cleaning is difficult. It must be kept in mind that the cleaning of corners and edges cannot be perfect and these uncleaned areas contribute little to heat transfer.

BRIEF DESCRIPTION OF THE DRAWINGS

Details of the invention will be apparent from the following description with reference to the drawings, in which.

BEST MODE OF THE CARRYING OUT OF THE INVENTION

Figure 1:
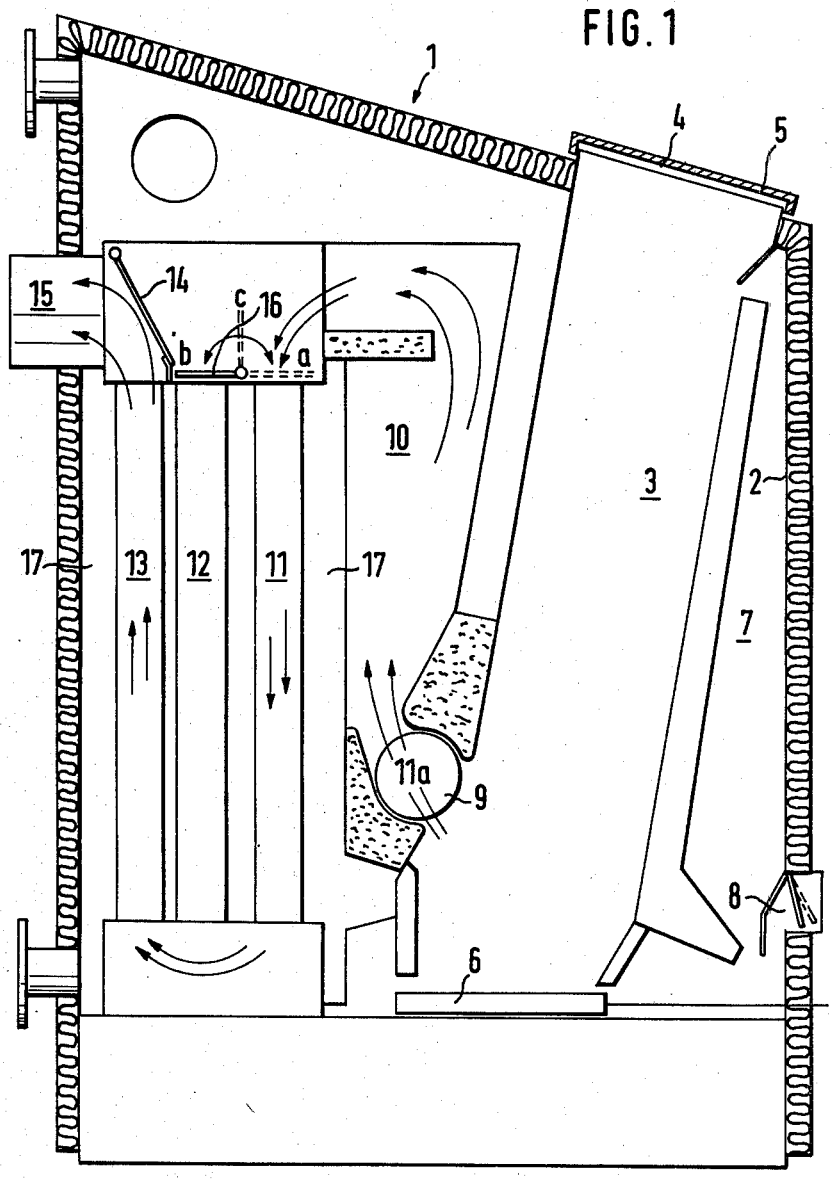
FIG. 1 is a longitudinal section through a boiler according to the invention.

The boiler 1, shown in FIG. 1 in longitudinal section, is surrounded by an insulation jacket 2. A hopper 3 is closed from above by a cover 4 which includes openings 5 for secondary air. The hopper 3 is at its bottom closed by a grate 6, through which the products of combustion fall in the form of ashes. Between the hopper 3 and the insulation jacket 2 of the boiler is situated a channel 7 which at its bottom part communicates with a controllable air inlet 8, to obtain complete combustion of the incompletely burned gases from the hopper 3.

A burner 9 for the burning of the liquid fuel is situated in a passage 11*a* between the hopper 3 and a combustion chamber 10. The upwardly flowing heating gas flows from the upper end of the combustion chamber 10 into the flow gas duct 11 and/or 12 and from there into an outlet duct 13.

An air flap 14 situated upstream of the flue 15, which is initially open when the boiler is fired with solid fuel, is, when regular combustion has been achieved, in the position shown in FIG. 1. The heating gases flow from the combustion chamber 10 into the flue gas duct 11, flow through this duct downwards and are deflected to flow upwardly through the outlet duct 13 and are discharged through the flue 15. In this method of operation the flue gas duct 12 is closed by a tiltable flap 16 situated at the upper end of the ducts 11 and 12 between said ducts. This position b is illustrated by a solid line.

When the boiler is reset for oil firing, the flap 16 is, in the illustrated example, tilted fully in the opposite direction so that the duct 11 is closed to the hot gases flowing downwardly. The flap position a is shown as a dashed line. In this method of operation the hot gases flow from the combustion chamber 10 through the duct 12 and transmit their heat to the heat exchangers 17 surrounding the chamber wall. The walls of the duct 11 which are covered with soot as a consequence of solid fuel firing, need not come into contact with hot gases when the boiler is fired with liquid fuel. In view of the good heat exchange output the temperatures of the outlet gases, which in this method of operation can be measured in the flue 15, are low according to the regulations.

When, however, a particularly high heating output of the boiler is needed it is possible, when oil firing, to open, by bringing the flap 16 into the dashed central position c, both the ducts 11 and 12 simultaneously to the hot gases flowing from the combustion chamber 10. The heat is then transferred by the hot gases flowing downwards both to the walls of the duct 12 and to the walls of the duct 11, even though the latter may have a reduced effect due to their being covered with soot as a consequence of previous firing of the boiler with solid fuel. The water to be heated is contained in water heating pockets 17 between the wall surfaces of the ducts 11 and 12. The wall surfaces of the ducts 11 and 12 also form the side wall surfaces of the flat heat exchangers 17 which are arranged spaced apart parallel to each other.

Figure 2:
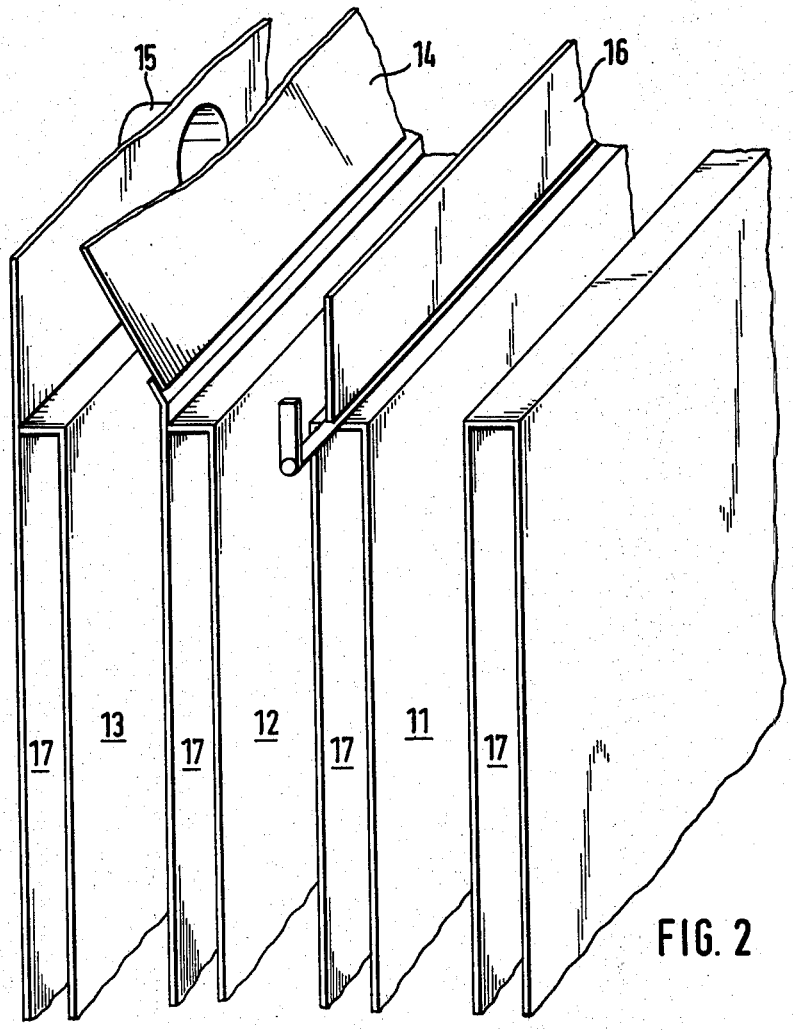
FIG. 2 shows three water heating pockets in perspective representation, partly broken away, incorporated in a boiler according to FIG. 1.
Figure 3:
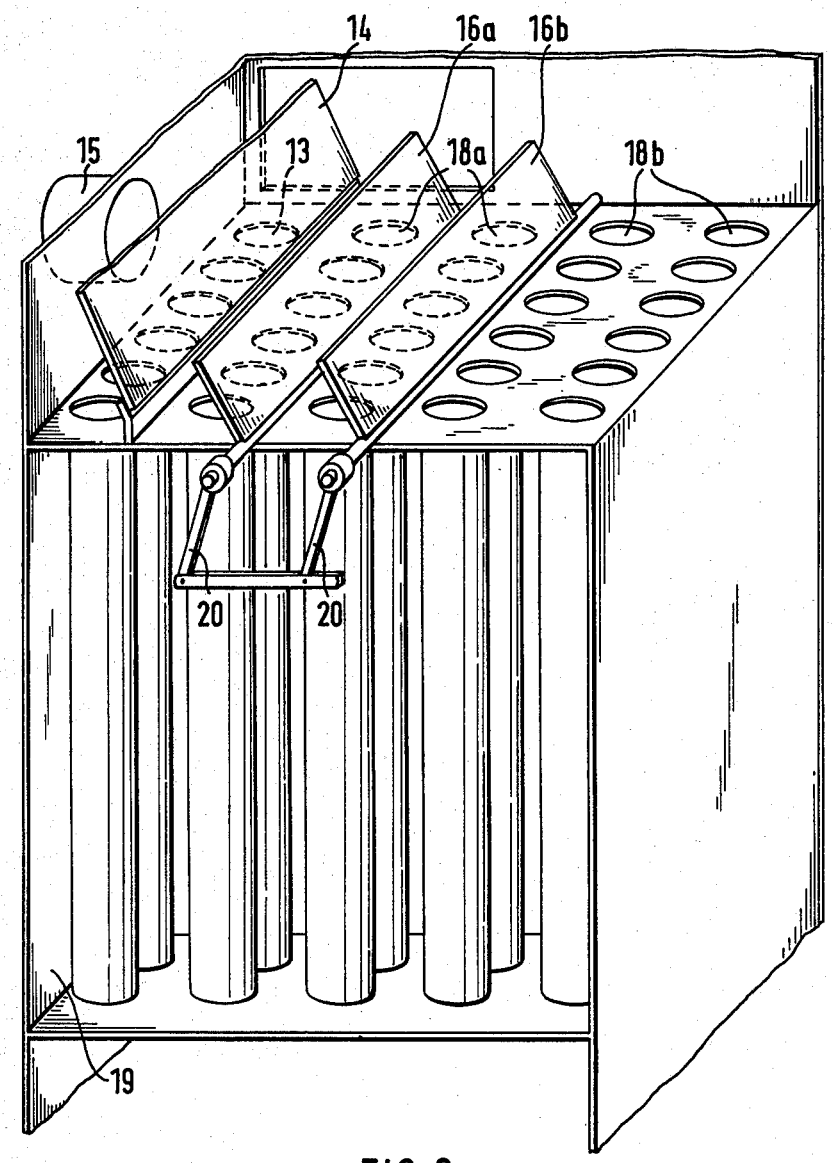
FIG. 3 shows a plurality of fire tubes in perspective representation used in a boiler instead of the flue gas ducts shown in FIGS. 1 and 2.

These water heating pockets 17 are shown in FIG. 2 in perspective. It is to be understood that when cleaned by brushes some areas of the heating pockets 17, particularly along their edges, may be reached only with difficulty so that an optimum performance of the heat exchanger may not be able to be achieved. Consequently fire tubes 18 are preferably used and combined together as flue gas ducts 18*a*, 18*b*, see FIG. 3.

The individual fire tubes are situated in the boiler mutually parallel and vertical and are surrounded by a jacket 19 for the flow of water. These fire tubes 18 can be thoroughly cleaned by a round brush without any uncleaned wall area covered with soot being left.

When one group of fire tubes 18 is used the flap 16, as is apparent from the drawing, is composed of individual flaps 16*a* , 16*b* fixed to links 20 which are all together manually controlled by means of a linkage. This enables the fire tubes to be partly or fully covered or opened in groups. This also allows energy control which corresponds to consumption.

In order to obtain the maximum heating output from the boiler the flaps 16 are positioned vertically and all the fire tubes 18*a*, 18*b* are opened for the flow of hot gases therethrough.

Figure 4:
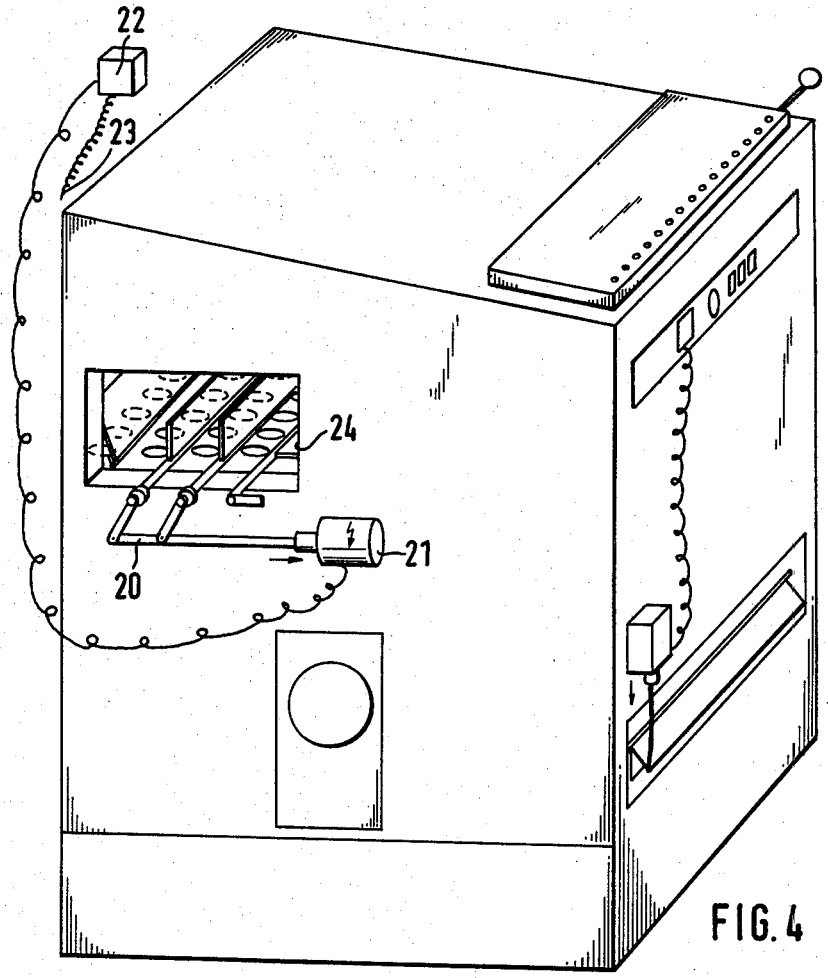
FIG. 4 shows a boiler with automatic control of flaps.

In the boiler illustrated in FIG. 4 the control linkage 20 is connected to a control mechanism 21. The latter is controlled via a thermostat 22 for outlet gases according to the temperature of the outlet gases measured in the flue by means of a sensor 23.

When the boiler is in operation it is possible, due to this arrangement, when the temperature of the outlet gases is high, to move the closure flaps to their opened position and therefore to use the heating energy better. If the temperature of the outlet gases drops, the fire tubes 18 may be either partly or fully closed. Complete covering of the ducts 18*a*, which is often desirable when the boiler is fired with solid fuel, may be obtained even when the control mechanism 21 is used. On the other hand even when the boiler is fired with liquid fuel a complete or partial closure of the ducts 18*b* for firing of the boiler with solid fuel may be obtained by means of a closure flap 24 controllable independently of the control mechanism and independently of the flap controlled by the control mechanism 21.

EXAMPLE

When the boiler is fired with solid fuel the boiler thermostat is set e.g. for 70° C. The flue gas ducts for firing with solid fuel are open. If the temperature of the outlet gases rises above e.g. 250° C., the control mechanism 21 opens the closure flaps 16*a*, 16*b* for the ducts 18 to such an extent and for so long that a temperature of the outlet gases of 250° C. is obtained. This ensures economical operation of the boiler.

When the boiler is oil fired the process is practically the same but in addition the ducts covered in soot may be closed manually if desired.

I claim:

1. An alternative fuel furnace for alternately burning solid and liquid fuel with heat heat transfer efficiency, said furance comprising:

a furnace housing;

oil burning means in said housing;

solid fuel burning means in said housing;

a combustion chamber in said housing and communicating with both said oil and solid fuel burning means;

combustion gas discharge means in said housing for removing combustion gases from said housing, said combustion gas discharge means including a flue gas pipe;

a plurality of chimney gas flues in the form of flue gas duct units in said housing, each of said flue gas duct units having an upper end connected to said combustion chamber and a second end connected to said flue gas pipe for flowing gases in a single direction;

means at said upper end of said flue gas duct units for selectively bypassing said gas flow directly from said combustion chamber to said combustion gas discharge means;

means at said upper end of said flue gas duct units for selectively restricting the gas flow to selected ones of said flue gas duct units, said means for selectively restricting comprising at least one tiltable closure flap arranged at the upper end of the flue gas duct units, wherein each said closure flap is arranged between two flue gas duct units and is positionable for alternate full or partial closure of one of the other of the flue gas duct units, wherein in a central position of each said at least one closure flap all of said flue gas duct units are open so that the flue gases may flow therethrough; and a control mechanism connected to said means for restricting, said control mechanism constructed to control said means for restricting depending upon the fuel being used and the temperature of the gases in said combustion gas discharge means, whereby the selective positioning of said means for restricting can prevent residue of said solid fuel from reducing the heat transfer efficiency of selected ones of said flue gas duct units.

2. The furnace according to claim 1 wherein said flue gas duct units are formed by a plurality of mutually parallel fire tubes.

3. The furnace according to claim 2 wherein said fire tubes are surrounded by a jacket for the flow of water to be heated.

4. The furnace according to claim 1 wherein said flue gas duct units are defined by spaced-apart mutually parallel wall surfaces.

5. The furnace according to claim 4 including means for supplying water between said flue gas duct units wherein said wall surfaces of the flue gas duct units define water heating pockets for the flow of water to be heated.

6. The furnace according to claim 1 wherein said flue gas duct units contact heat exchange fluid ducts to form heat exchangers.

7. The furnace of claim 1 having two groups of flue gas duct units wherein each said closure flap incorporates at least two individual flaps which may at least partly close groups of flue gas ducts.

8. The furnace according to claim 1 wherein said at least one closure flaps are controlled from said control mechanism positioned outside said furnace.

9. The furnace according to claim 8 wherein said control mechanism is connected to at least one of said closure flaps for the control of said at least one closure flaps, said control mechanism adapted to control the position of said at least one closure flaps.

* * * * *